US008336169B2

(12) United States Patent
Brüssel

(10) Patent No.: US 8,336,169 B2
(45) Date of Patent: Dec. 25, 2012

(54) CONVERTER FOR THE CONVERSION OF ONE OR MORE FIBERS INTO STAPLE FIBERS

(75) Inventor: Richard Brüssel, Sulzfeld (DE)

(73) Assignee: Schmidt & Heinzmann GmbH & Co. KG, Bruchsal (DE)

( * ) Notice: Subject to any disclaimer, the term of this patent is extended or adjusted under 35 U.S.C. 154(b) by 227 days.

(21) Appl. No.: 12/734,395

(22) PCT Filed: Oct. 24, 2008

(86) PCT No.: PCT/EP2008/009008

§ 371 (c)(1),
(2), (4) Date: Aug. 2, 2010

(87) PCT Pub. No.: WO2009/056258

PCT Pub. Date: May 7, 2009

(65) Prior Publication Data

US 2010/0287737 A1 Nov. 18, 2010

(30) Foreign Application Priority Data

Nov. 3, 2007 (DE) ..... 10 2007 052 587

(51) Int. Cl.
*D01G 1/02* (2006.01)

(52) U.S. Cl. ..... 19/0.3

(58) Field of Classification Search ..... 19/0.3, 19/0.58, 0.6

See application file for complete search history.

(56) References Cited

U.S. PATENT DOCUMENTS

| | | | | |
|---|---|---|---|---|
| 2,782,853 | A | 8/1955 | Heffelfinger | |
| 2,719,336 | A | 10/1955 | Stotler | |
| 2,729,028 | A | 1/1956 | Slayter et al. | |
| 2,961,909 | A | 11/1960 | Hemker et al. | |
| 3,119,294 | A | 1/1964 | Billingsley et al. | |
| 3,908,232 | A | 9/1975 | Okayama et al. | |
| 4,377,098 | A * | 3/1983 | Bardenhagen et al. | 83/310 |
| 4,655,111 | A * | 4/1987 | Blaker et al. | 83/356.3 |
| 4,806,298 | A * | 2/1989 | Wilkinson et al. | 264/115 |
| 6,575,069 | B1 | 6/2003 | Harwarth et al. | |
| 7,578,222 | B2 | 8/2009 | Liebheit | |
| 2006/0065091 | A1 * | 3/2006 | Liebheit | 83/425.4 |
| 2007/0089575 | A1 | 4/2007 | Billingsley | |

FOREIGN PATENT DOCUMENTS

| | | |
|---|---|---|
| GB | 754610 | 8/1956 |
| JP | A-H07-501589 | 2/1995 |
| JP | A-2005-325465 | 11/2005 |

OTHER PUBLICATIONS

International Search Report mailed on Jul. 23, 2009 for the corresponding International patent application No. PCT/EP2008/009008 (English translation enclosed).

German Search Report mailed on Jul. 31, 2008 for the corresponding German patent application No. 10 2007 052 587.9 (German language report enclosed).

* cited by examiner

*Primary Examiner* — Shaun R Hurley
(74) *Attorney, Agent, or Firm* — Posz Law Group, PLC

(57) ABSTRACT

A cutting device, in particular a converter cutting device, comprising at least one cutting unit that is configured to rotate, and at least one counterweight unit that is provided, at least partially, to compensate a centrifugal force active on the cutting unit during the operation thereof.

22 Claims, 4 Drawing Sheets

CONVERTER FOR THE CONVERSION OF ONE OR MORE FIBERS INTO STAPLE FIBERS

CROSS REFERENCE TO RELATED APPLICATIONS

This application is a U.S. national stage application of PCT/EP2008/009008 filed on Oct. 24, 2008, and claims priority to, and incorporates by reference, German patent application No. 10 2007 052 587.9 filed on Nov. 3, 2007.

BACKGROUND

The invention relates to a converter, in particular for the conversion of one or more fibers, in particular of continuous fibers, into staple fibers.

SUMMARY

A converter, in particular for the conversion of one or more fibers into staple fibers, with at least two fiber exit units and with a central setting unit, is proposed, which is intended, at least in one mode, for simultaneously setting cutting gaps assigned to the at least two fiber exit units. A "fiber exit unit" is to be understood in this context as meaning, in particular, a unit which is intended for guiding a fiber and/or which is intended for dispensing a fiber into a cutting region, such as, in particular, a nozzle unit. A "central setting unit" is to be understood, in particular, as meaning a unit, preferably a mechanical unit, which is intended for setting a plurality of cutting gaps in a convenient way centrally, preferably in at least one mode, at least partially simultaneously and/or preferably by means of at least one central setting means which is intended for acting, specifically preferably simultaneously, upon a plurality of means for setting. A "cutting gap" is to be understood, in particular, as meaning a spatial arrangement of a cutter with respect to a component, such as, in particular, a mating cutter, which matches with the cutter during a cut. Furthermore, "intended" is to be understood, in particular, as meaning especially equipped, designed and/or programmed.

Convenient and rapid setting can be made possible by means of a corresponding configuration according to the invention.

The central setting means may be formed by various means which seem expedient to a person skilled in the art, such as, for example, by a gearwheel, a toothed belt, etc. If the setting means is formed by a rack, however, the possibility of especially exact setting can be implemented simply and cost-effectively in structural terms, specifically, in particular, in that the rack is coupled to a plurality of gearwheels for setting.

Furthermore, it is proposed that the converter have at least one individual setting unit which is intended for setting at least one cutting gap independently of at least one further cutting gap, with the result that especially flexible and accurate setting can be ensured.

If the individual setting unit and the central setting unit are formed at least partially in one piece, additional components, assembly outlay and costs can be saved.

A unit, in particular a moved bearing unit, which is moved during operation and/or especially advantageously a unit, in particular a bearing unit, which is stationary during operation can be designed so as to be capable of being set by means of the central setting unit and/or by means of an individual setting unit, with the result that a structurally simple tie-up can be implemented. In this case, the converter preferably has at least two bearing units which are stationary during operation and which can be set by means of the central setting unit.

Furthermore, a converter for the conversion of one or more fibers into staple fibers, with at least one thermal setting unit, is proposed. A "thermal setting unit" is in this context to be understood, in particular, as meaning a setting unit which is deliberately intended for setting a temperature and/or, by means of the setting of a temperature, for setting a dimension and/or position of a component, such as, in particular, a cutting unit. In this case, by means of the thermal setting unit, a temperature change which occurs, such as is caused by friction particularly during operation, can be at least partially counteracted and/or can be compensated, and/or a specific temperature can also be set in a directed manner for setting purposes.

By virtue of a corresponding configuration according to the invention, especially accurate setting can be achieved and, in particular, can also be maintained during operation.

The thermal setting unit may have various means for cooling and/or heating, which seem expedient to a person skilled in the art, such as, in particular, electrical heating elements, cooling elements, such as heat pipes, etc. Especially advantageously, however, the thermal setting unit comprises at least one flow medium, by means of which larger regions can be heated and/or, in particular, cooled to a desired temperature in a simple way. In this context, various flow media which seem expedient to a person skilled in the art may be envisaged, such as air, an air mixture, oil or preferably water or a water mixture.

Furthermore, advantageously, regions capable of being influenced thermally can be achieved if the thermal setting unit has at least one ring duct.

The thermal setting unit may be intended for various settings which seem expedient to the person skilled in the art, such as solely for setting a temperature in order to avoid undesirably high temperatures, and/or, however, especially advantageously, for setting at least one cutting gap, with the result that the latter can be set especially exactly and/or can be held at a specific exact setting.

Furthermore, a converter for the conversion of one or more fibers into staple fibers, with a control and/or regulation unit, which is intended for at least partly automated setting, is proposed. A "control and/or regulation unit" is to be understood in this context as meaning, in particular, a unit with a computing unit, with a memory and/or with an operating program stored in the memory. The control and/or regulation unit may in this case process different parameters for setting which seem expedient to a person skilled in the art, such as, in particular, a machining time, a sensed temperature, a tool life, etc. Furthermore, the control and/or regulation unit may be intended for setting various parameters, but especially advantageously a temperature and/or, in particular, at least one cutting gap, by means of an individual setting unit, by means of a central setting unit and/or by means of a thermal setting unit. A corresponding control and/or regulation unit can conveniently ensure advantageously exact setting.

Preferably, a converter has at least one and especially preferably a plurality of cutting bearing units that are drivable in rotation and, in particular, one or preferably a plurality of cutting units that are drivable in rotation, with the result that an advantageous throughput can be achieved, specifically, in particular, when the converter has at least two fiber exit units assigned to the cutting bearing unit that is drivable in rotation. A cutting unit that is drivable in rotation and is mounted by means of the cutting bearing unit can in this case cooperate with one or preferably with a plurality of mating cutting units that are likewise moved during operation and/or especially advantageously with one or a plurality of mating cutting units that are stationary during operation, with the result that undesirable fiber twists can advantageously be avoided during operation.

The thermal setting unit may be coupled to various units, such as, advantageously, to a stationary cutting unit and/or, especially advantageously, to a cutting bearing unit that is drivable in rotation, with the result that an advantageous setting can be achieved.

Furthermore, it is proposed that the converter have at least one drive unit which is intended for driving at least two cutting bearing units that are drivable in rotation, with the result that components, construction space, assembly outlay and costs can be saved. This can be achieved in an especially simple and space-saving way in structural terms if the drive unit has at least one toothed belt.

In a further refinement of the invention, it is proposed that the converter have at least one spring unit which is intended for generating a setting force, with the result that the latter can be metered especially advantageously. The spring unit may have one or preferably a plurality of springs, such as, for example, one or a plurality of helical compression springs, and/or, advantageously, one or a plurality of cup springs which can advantageously be integrated in a space-saving way.

Furthermore, it is proposed that the converter have at least one bearing unit which is intended to be deformed elastically during setting. A "bearing unit" is in this context to be understood as meaning, in particular, a unit which is intended for the mounting of a cutting means and/or of a component matching with a cutting means and which is deformed elastically for setting purposes. By virtue of a corresponding configuration, the possibility of an especially exact setting can be achieved in a simple way, specifically, in particular, when the bearing unit has a hinge intended for elastic deformation, in which case a "hinge" is to be understood as meaning, in particular, a unit, by means of which two legs are mounted so as to be movable in relation to one another.

BRIEF DESCRIPTION OF THE DRAWINGS

Further advantages may be gathered from the following drawing description. The drawing illustrates an exemplary embodiment of the invention. The drawing, description and claims contain numerous features in combination. A person skilled in the art would expediently also consider the features individually and combine them into expedient further combinations.

DETAILED DESCRIPTION OF THE PREFERRED EMBODIMENTS

Figure 1:
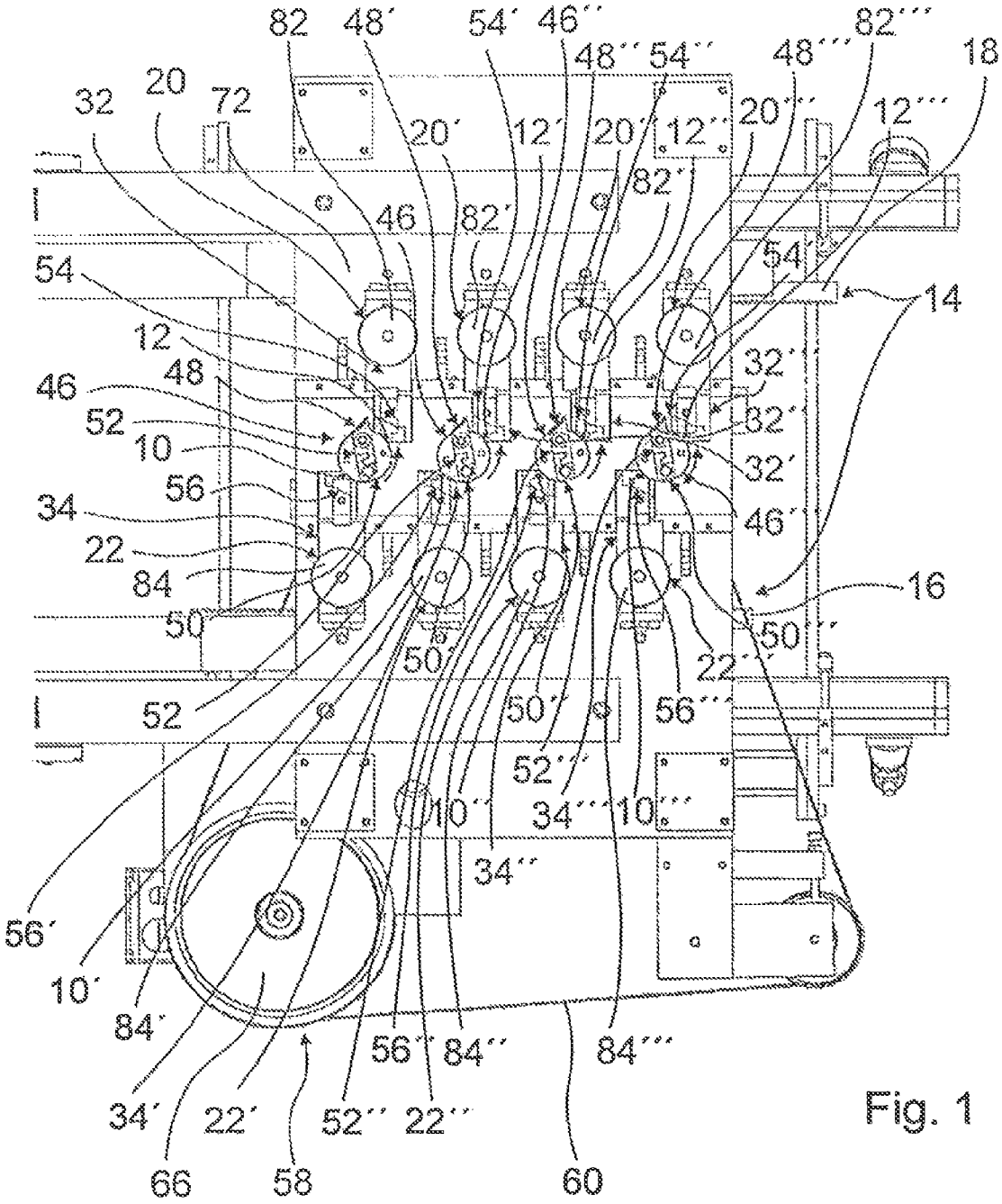
FIG. 1 is a converter from below.

FIG. 1 shows a converter for the conversion of a plurality of continuous fibers into staple fibers. The converter comprises spindles which form four cutting bearing units 46, 46', 46", 46'" that are drivable in rotation and on the end face of which in each case a cutting unit 48, 48', 48", 48'" with a cutting means and with a fastening means and also a counterweight unit 50, 50', 50", 50'" are arranged, which units are coupled via a positive coupling 52, 52', 52", 52'". The cutting units 46, 46', 46", 46'" cooperate, during operation, in each case with two stationary mating cutting units 54, 54', 54", 54'", 56, 56', 56", 56'". As seen in the direction of rotation of the spindles, each mating cutting unit 54, 54', 54", 54'", 56, 56', 56", 56'" is preceded by a fiber exit unit 10, 10', 10", 10'", 12, 12', 12", 12'" which is stationary during operation and in each case comprises a nozzle. The fiber exit unit may also consist of a plurality of individual fiber feeds.

Figure 2:
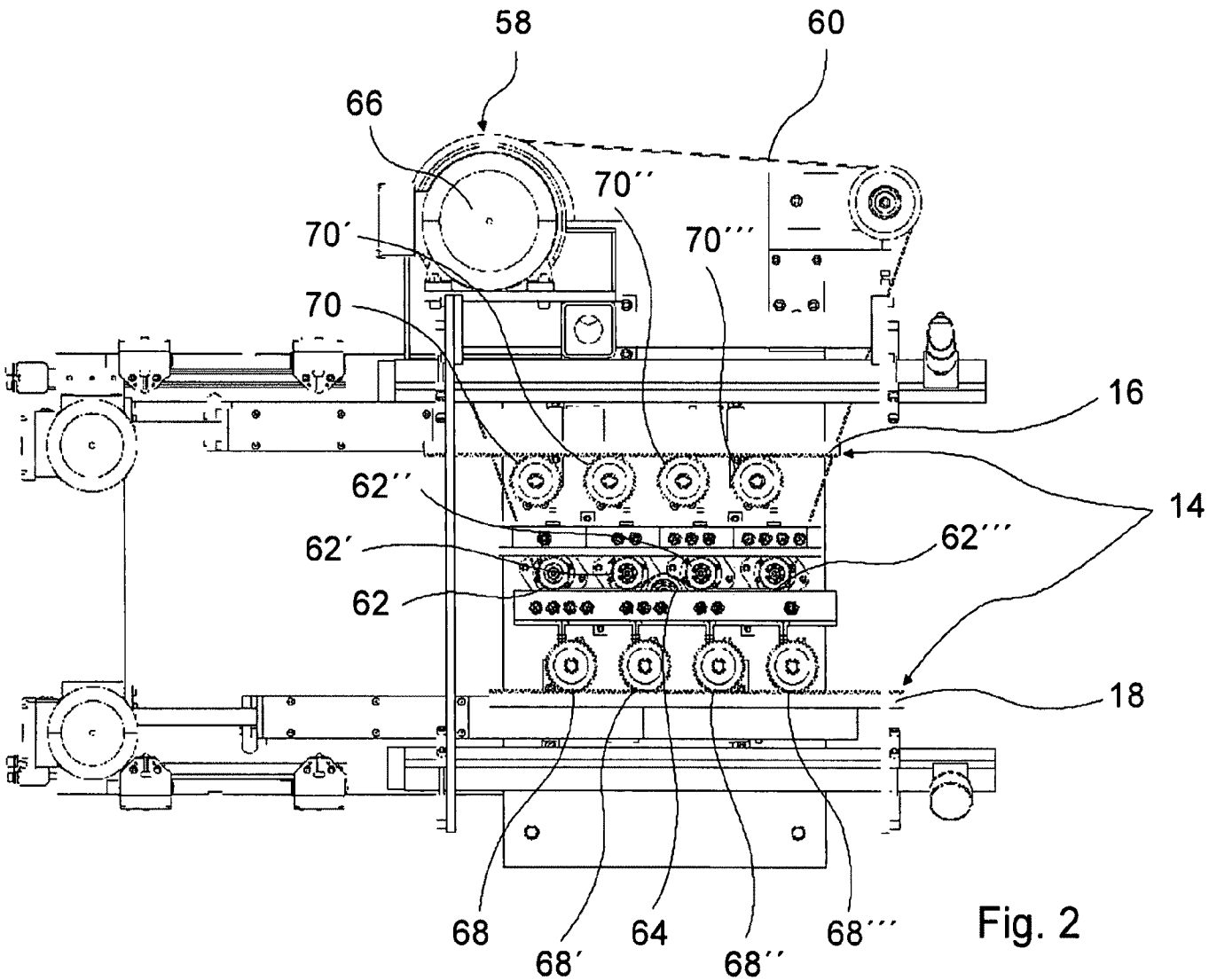
FIG. 2 is the converter from FIG. 1 from above.

The converter comprises a drive unit 58, which is intended for driving four cutting bearing units 46, 46', 46", 46'" that are drivable in rotation. The drive unit 58 has a toothed belt 60 which is coupled to gearwheels 62, 62', 62", 62'" coupled in each case to the spindles (FIG. 2). In order to ensure an advantageous engagement of the toothed belt 60 with the gearwheels 62, 62', 62", 62'", the converter has a deflecting roller 64 which is intended for deflecting the toothed belt 60 in order to enlarge a toothed belt engagement region. The deflecting roller 64 is arranged between the two middle spindles and serves for enlarging a toothed belt engagement region of the toothed belt 60 with the gearwheels 62', 62" assigned to the two middle spindles. The toothed belt 60 is coupled to an individual motor 66. The motor 66 is formed by an electric motor, but could also be formed by other motors which seem expedient to a person skilled in the art.

The converter comprises a central setting unit 14 which is intended for centrally setting cutting gaps assigned to the fiber exit units 10, 10', 10", 10'", 12, 12', 12", 12'". The central setting unit 14 comprises two setting means 16, 18 which are formed by racks and by means of which in each case four cutting gaps can simultaneously be set centrally. The setting means 18 cooperates with gearwheels 68, 68', 68", 68'" arranged on a first side of the spindles and assigned in each case to a bearing unit 32, 32', 32", 32'" of the mating cutting units 54, 54', 54", 54'", and the setting means 16 cooperates with gearwheels 70, 70', 70", 70'" arranged on a second side of the spindles and assigned in each case to a bearing unit 34, 34', 34", 34'" of the mating cutting units 56, 56', 56", 56'" (FIGS. 1 and 2).

Furthermore, the converter comprises eight individual setting units 20, 20', 20", 20'", 22, 22', 22", 22'" which are assigned in each case to a cutting gap and which are intended for setting each cutting gap independently of the other cutting gaps (FIG. 1). The central setting unit 14 and the individual setting unit 20, 20', 20", 20'", 22, 22', 22", 22'" are formed partially in one piece and both serve for setting the bearing units 32, 32', 32", 32'", 34, 34', 34", 34'", stationary during operation, of the mating cutting units 54, 54', 54", 54'", 56, 56', 56", 56'".

Figure 3:
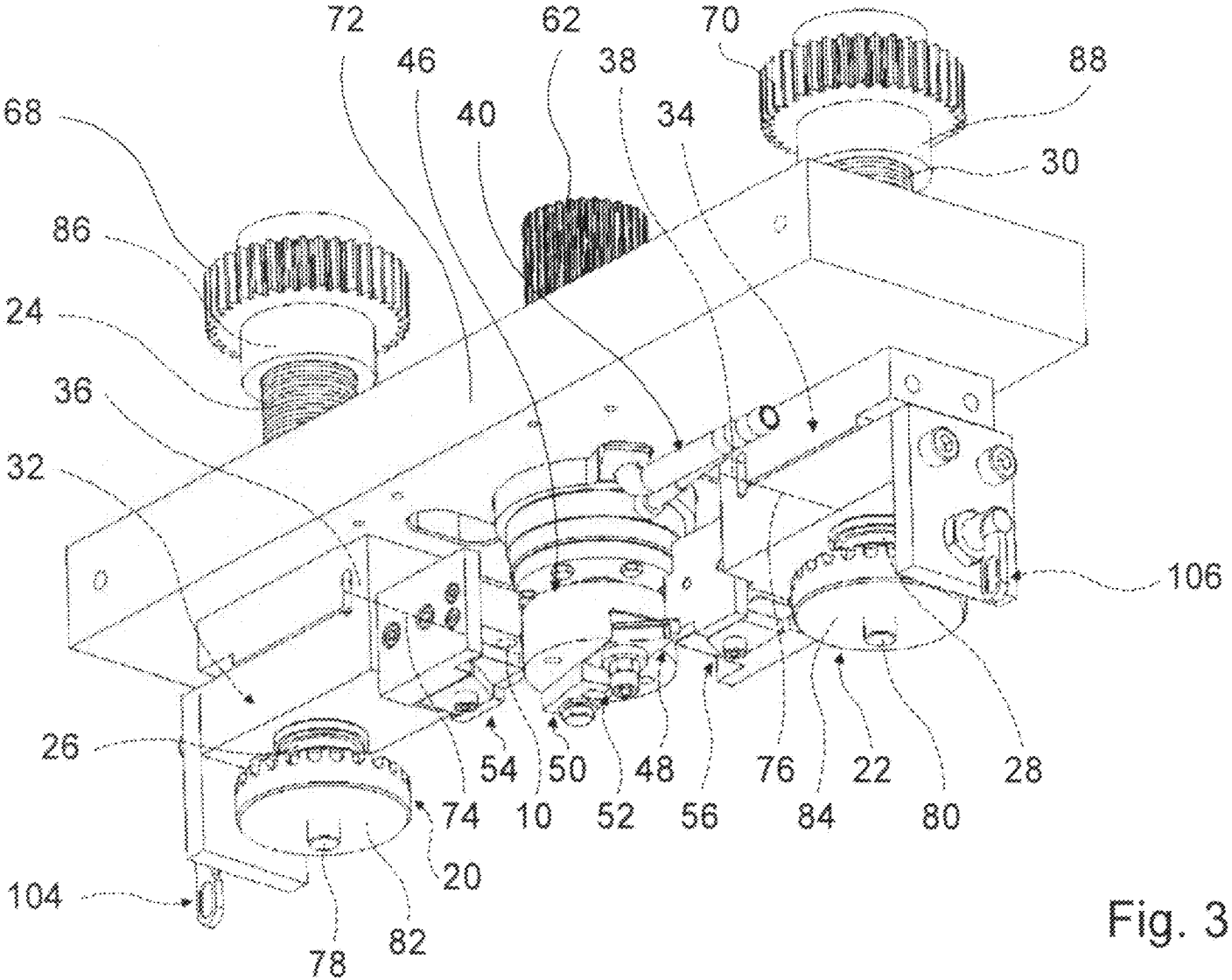
FIG. 3 is a diagrammatically illustrated detail of the converter with a cutting unit that is drivable in rotation and with stationary cutting units.

The converter has four main cutting units which essentially correspond to one another and which comprise in each case, in particular, a cutting bearing unit 46, 46', 46", 46'", a cutting unit 48, 48', 48", 48'", arranged on it, and a counterweight unit 50, two mating cutting units 54, 54', 54", 54'", 56, 56', 56", 56'" and the bearing units 32, 32', 32", 32'", 34, 34', 34", 34'" supporting the two mating cutting units, and also in each case two fiber exit units 10, 10', 10", 10'", 12, 12', 12", 12'" arranged directly in front of the mating cutting units 54, 54', 54", 54'", 56, 56', 56", 56'". Only the set-up of the main cutting unit illustrated in FIG. 3 is partially dealt with below for the sake of clarity, and, with regard to the remaining main cutting units, reference shall be made to the description of the main cutting unit illustrated in FIG. 3.

The bearing units 32, 34 of the mating cutting units 54, 56 are intended to be deformed elastically during setting (FIG. 3), The bearing units 32, 34 have in each case a bearing body formed by a U-profile and having two kgs Which are fastened on a baseplate 72. The legs are in each case connected via a hinge 36, 38 intended for elastic deformation. The legs of the bearing bodies are in each case penetrated by a threaded shaft 78, 80 perpendicularly to the baseplate 72 and perpendicularly to a hinge pivot axis 74, 76, the gearwheels 68, 70 of the central setting unit 14 being arranged on the threaded shafts 78, 80 on a top side and setting means 82, 84 of the individual setting units 20, 22 being arranged on an underside. The gearwheels 68, 70 are coupled fixedly in terms of rotation to the threaded shafts 78, 80 and are mounted rotatably with respect to sleeves 86, 88 via axial bearings. The setting means 82, 84 are mounted rotatably on the threaded shafts 78, 80 via a threaded connection, and they are supported via axial bearings 26, 28, The setting means 82, 82', 82",82'", 84, 84', 84', 84'", respectively, for each of the eight individual setting units 20, 20',20", 20'", 22, 22', 22",22'" can be in FIG. 1, Cup springs of spring units 24, 30, which are intended for generating a setting force, are arranged between the sleeves 86, 88 and the baseplate 72.

For setting by means of the central setting unit 14, the setting means 82, 84 are locked in the direction of rotation by means of locking units 104, 106, so that the gearwheels 68, 70 can be rotated together with the threaded shaft 78, 80 by means of the racks 16, 18, and consequently axial distances between the sleeves 86, 88 and the baseplate 72 or between the sleeves 86, 88 and the setting means 82, 84, and therefore tension forces acting upon the legs of the bearing bodies by the cup springs can be set, without the setting means 82, 84 corotating. As a result of the tension forces which arise, pivot angles, in particular, of the legs, facing away from the baseplate 72, of the bearing bodies about the hinge pivot axes 74, 76 are set, and consequently in each case a position of the mating cutting units 54, 56 with respect to the cutting unit 48 arranged on the cutting bearing unit 46 is set. As a result of corresponding position setting, the cutting gaps assigned to the fiber exit units 10, 12 are set. Alternatively or additionally, individual setting for setting the tension force generated by the cup springs may be carried out by means of the setting means 82, 84, and in this case, preferably, the gearwheels 68, 70, together with the threaded shafts 78, 80, are fixed in their direction of rotation via the racks, and the setting means 82, 84 are rotated.

Figure 4:
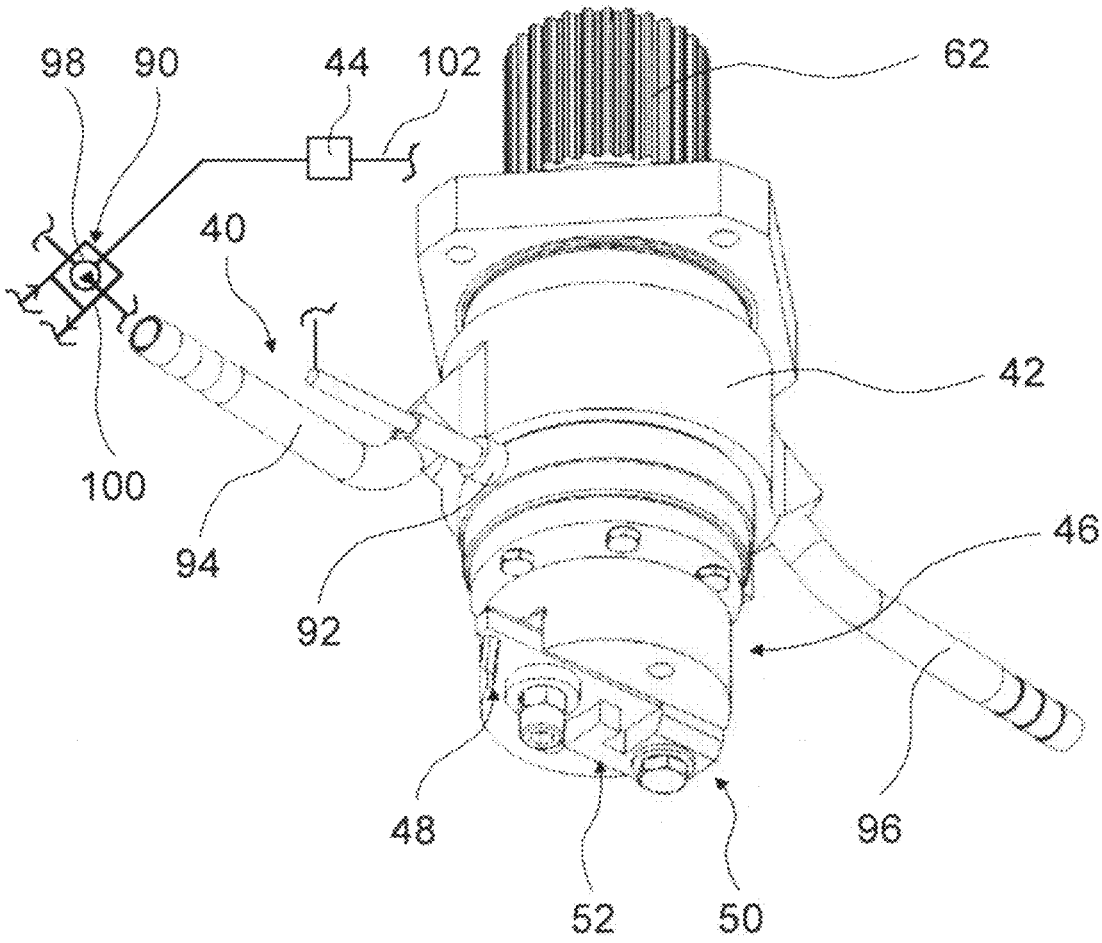
FIG. 4 is an individual illustration of a spindle with the cutting unit that is drivable in rotation.

Furthermore, the converter has a thermal setting unit 40 which is intended likewise for setting cutting gaps and which has ring ducts 42 which are intended for routing a flow medium formed from water and which in each case surround the spindles or the cutting bearing units 46, 46', 46", 46'" that are drivable in rotation, and which is consequently coupled thermally to these (FIG. 4).

The converter comprises a control and regulation unit 44 with a processor, with a memory and with an operating program stored therein, which unit is intended for carrying out automated setting. By means of the control and regulation unit 44, a pump unit 90 and consequently a temperature of the spindles and, via the temperature of the spindles, the cutting gaps can be regulated to a desired value. The pump unit 90 comprises a pump 98 and a settable heat exchanger 100, via which a temperature of the flow medium can be set. The control and regulation unit 44 is coupled to temperature sensors 92 which are arranged on bearing units of the spindles and via which temperatures of the spindles, specifically, in particular, bearing temperatures of the spindles, can be detected. The flow medium is supplied by the pump 98 to the ring ducts 42 via supply ducts 94 and is discharged via discharge ducts 96.

Furthermore, the control and regulation unit 44 is coupled via a data line 102 to drive units of the setting means 16, 18 of the central setting unit 14, specifically so that automated setting can be carried out via the central setting unit 14. In addition to automated temperature regulation, automated adjustment by means of the central setting unit 14 and/or also by means of individual setting units could also be implemented. For this purpose, sensors are preferably provided, which deliver parameters relating to a desired cutting gap, such as, for example, optical sensors, pressure sensors, etc.

Before commissioning, the cutting gaps are exactly set manually by means of the individual setting unit 20, 20', 20", 20'", 22, 22', 22", 22'". Subsequently, the cutting gaps are enlarged by means of the central setting unit 14 to a dimension such that the converter can be brought to its operating temperature, without the cutting units 48, 48', 48", 48'" and the mating cutting units 54, 54', 54", 54'", 56, 56', 56", 56'" coming into bearing contact. When a desired operating temperature is reached, the cutting gaps are reduced to a desired dimension by means of the control and regulation unit 44 via the central setting unit 14, so that an advantageous cutting function can be achieved.

During operation, the cutting units 48, 48', 48", 48'" driven in rotation cooperate in each case with the mating cutting units 54, 56, 54', 56', 54", 56", 54'", 56'" assigned to them (FIG. 1). The cutting bearing units 46, 46', 46", 46'" are assigned in each case two fiber exit units 10, 12, 10', 12', 10", 12", 10'", 12'", out of which continuous fibers intended to be cut are discharged during operation. The fibers are preferably discharged at least essentially parallel to the axes of rotation of the cutting bearing units 46, 46', 46", 46'", that is to say with a deviation of less than 10° and preferably of less than 5° with respect to a parallel to the axes of rotation. The converter has a compressed air unit which is intended for generating a compressed air stream through the fiber exit units 10, 12, 10', 12', 10", 12", 10'", 12'" and at the same time conveying and aligning the fibers.

The conveying airstream can be regulated by means of a heat exchanger to a temperature which positively influences the cutting result, does not vary the cutting gap and maintains the cutter temperature.

The invention claimed is:

1. A converter for the conversion of one or more fibers into staple fibers, comprising at least two fiber exit units;

a central setting unit which is, at least in one mode, for centrally setting cutting gaps assigned to the at least two fiber exit units, and at least one individual setting unit for setting at least one cutting gap independently of at least one further cutting gap.

2. The converter as claimed in claim 1, wherein the central setting unit comprises at least one central setting means, by means of which the cutting gaps can be simultaneously set centrally.

3. The converter as claimed in claim 2, wherein the central setting means is formed by a rack.

4. The converter as claimed in claim 1, wherein the individual setting unit and the central setting unit are formed at least partially in one piece.

5. The converter as claimed in claim 1, further comprising at least one unit which is stationary during operation and which can be set by means of the central setting unit and/or by means of an individual setting unit.

6. The converter as claimed in claim 5, further comprising at least two bearing units which are stationary during operation and which can be set by means of the central setting unit.

7. The converter as claimed in claim 1, further comprising at least one thermal setting unit.

8. The converter as claimed in claim 7, wherein the thermal setting unit comprises a flow medium.

9. The converter as claimed in claim 8, wherein the thermal setting unit has at least one ring duct.

10. The converter as claimed in claim 7, wherein the thermal setting unit is intended for setting at least one cutting gap.

11. The converter as claimed in claim 1, further comprising a control and/or regulation unit for at least partly automated setting.

12. The converter as claimed in claim 11, wherein the control and/or regulation unit is for setting at least one cutting gap in an at least partly automated manner.

13. The converter as claimed in claim 1, further comprising at least one cutting bearing unit that is drivable in rotation.

14. The converter as claimed in claim 13, further comprising at least two fiber exit units assigned to the cutting bearing unit that is drivable in rotation.

15. The converter at least as claimed in claim 7, wherein the thermal setting unit is coupled to the cutting bearing unit that is drivable in rotation.

16. The converter at least as claimed in claim 13, further comprising at least one second cutting bearing unit that is drivable in rotation.

17. The converter as claimed in claim 16, further comprising at least one drive unit which is for driving the at least two cutting bearing units that are drivable in rotation.

18. The converter as claimed in claim 17, wherein the drive unit has at least one toothed belt.

19. The converter as claimed in claim 1, further comprising at least one spring unit for generating a setting force.

20. The converter as claimed in claim 19, wherein the spring unit has at least one cup spring.

21. The converter as claimed in claim 1, further comprising at least one bearing unit which is deformed elastically during setting.

22. The converter as claimed in claim 21, wherein the bearing unit has a hinge for elastic deformation.

* * * * *